United States Patent [19]

Geiger

[11] Patent Number: 4,697,945

[45] Date of Patent: Oct. 6, 1987

[54] BINDER FOR SHEET MATERIAL

[75] Inventor: John A. Geiger, Milwaukee, Wis.

[73] Assignee: Majestic Industries, Inc., Teterboro, N.J.

[21] Appl. No.: 797,743

[22] Filed: Nov. 8, 1985

Related U.S. Application Data

[63] Continuation-in-part of Ser. No. 673,186, Nov. 19, 1984, abandoned.

[51] Int. Cl.[4] ..... B42F 13/00

[52] U.S. Cl. ..... 402/75; 402/80 R; 411/466; 411/472; 411/496

[58] Field of Search ..... 402/73, 75, 47, 56, 402/80 R; 411/466, 467, 468, 471, 472, 496, 499; 16/382, 383

[56] References Cited

U.S. PATENT DOCUMENTS

| | | | |
|---|---|---|---|
| 989,968 | 4/1911 | Heil | 402/75 |
| 1,114,237 | 10/1914 | Diamond | 411/496 X |
| 1,699,907 | 5/1925 | Newman | 402/75 |
| 1,791,693 | 2/1931 | Trussell | 411/466 X |
| 2,282,624 | 5/1942 | Upson et al. | 411/466 |
| 2,380,655 | 7/1945 | Lang | 411/472 |
| 3,667,337 | 6/1972 | Burke | 411/467 |

*Primary Examiner*—Howard N. Goldberg
*Assistant Examiner*—Taylor J. Ross
*Attorney, Agent, or Firm*—Lieberman Rudolph & Nowak

[57] ABSTRACT

An improved binder for sheet material. The binder includes a cover or backing member formed of paperboard or plastic, and a pair of hinge assemblies are attached to the inner surface of the cover. A standard binding mechanism is interconnected between the hinge assemblies and serves to retain the sheet material. Each hinge assembly includes a metal hinge plate that is secured flatwise to the cover by a plurality of stamped out prongs. Each prong is generally triangular in configuration and is provided with a curved pointed tip. The prongs have a length substantially greater than the thickness of the backing member and when embedded by pressure, the configuration of the prongs causes the prongs to curl within the cover, so that the prongs are completely embedded in the cover and not exposed on the outer surface of the cover.

16 Claims, 7 Drawing Figures

BINDER FOR SHEET MATERIAL

This application is a continuation-in-part of U.S. Ser. No. 673,186, filed Nov. 19, 1984, now abandoned.

BACKGROUND OF THE INVENTION

This invention relates generally to a binder for retaining sheet material, that allows the user to access individual sheets, for removals or additions. Binders generally include a cover or backing member which is folded or bent along parallel lines to form a front section, a rear section, and a center spine section interconnecting the front and rear sections, and a mechanical binding mechanism fixedly attached to the backing member.

Binders of the type herein are typically used to retain rectangular sheet material having three holes punched along one edge. One popular binding mechanism comprises a post bar assembly having a three-rod ladder configuration for holding the sheet material, mounted by way of a hinge assembly to the rear section, adjacent to the spine, and further comprises a retaining or locking assembly mounted by way of another hinge assembly to the front section of the backing member. In this mechanism, the post bar assembly has a transfer bar, and swings on the hinge assembly to meet with a locking assembly having a locking bar that slidably and removably connects to the transfer bar.

Another binding mechanism comprises a three-ring assembly mounted to the spline or rear section of the backing member, and having a toggled joint for opening and closing the rings to provide access to the sheet material. The toggled joint is actuated by releases at either or both ends of the assembly, or by pulling and pushing the rings themselves. These binding mechanisms are referred to herein as "binding assemblies".

Heretofore, binding assemblies were mounted to the cover by rivets, accordingly leaving the heads of the rivets exposed on the outer surface of the cover or backing member. For example, in the post and lock bar binder, the hinge assemblies are typically connected by rivets to the respective front and rear cover sections. In the three-ring binder, rivets are placed through the binder, between the rings, and typically attached to the spine section of the cover.

These exposed rivets present a number of drawbacks, including an unaesthetic and unattractive appearance, requiring, in the past, the additional application of an outer cover to hide the rivet heads.

Heretofore, an alternative to the outer cover was provided by the use of a fabric hinge, in which the metal hinge strips of the post and lock bar binder are replaced with strips or layers of fabric material glued to the cover and binding mechanism, wherein the fabric material itself serves as the hinge assembly. Although obviating the need and use of rivets, this fabric hinge, like rivets, possesses a number of drawbacks. Fabric hinges lack durability in comparison to metal hinge assemblies, are labor intensive, and do not lend themselves to the use of automated equipment in assembly.

These drawbacks are effectively eliminated through use of the instantly disclosed and claimed improved binder for sheet material.

It is, therefore, an object of the present invention to provide a strong, durable and non-labor intensive connection mechanism for attaching the hinge assemblies, or three-ring binder mechanisms to the cover, which substantially improves the length of service of the binder.

It also an object of the present invention to provide a binder with no exposed fasteners on the outer surface of the cover, thereby eliminating the need for application of an outer cover.

It is still a further object of the present invention to provide a binder mechanism that can be simply and effectively attached to a cover after the cover is produced with automated equipment, and with a minimum of hand labor.

SUMMARY OF THE INVENTION

The foregoing and other objects of the present invention are achieved through the provision of an improved binder for sheet material in which the binder assemblies are attached to the inner surface of the cover section through a plurality of prongs that are each stamped or punched out of a metal attachment plate. The shape, size and angular construction of these prongs is critical, and provides a surprisingly simple, yet strong and durable attachment, which simultaneously minimizes or eliminates the need and use of manual labor, maximizes automated manufacturing and assembly, and results in a binder with improved durability and aesthetic appearance.

More particularly, in the post and lock bar binder, each hinge assembly has a metal hinge plate or strip that is provided with a plurality of critically curvilinear, but generally triangular prongs. Similarly, in the three-ring binder, there is provided a rear binding plate with these prongs. Prior to assembly of the hinge assembly or rear ring supporting plate to the cover section, each prong is located at an angle of between, approximately 5 degrees to 15 degrees with respect to a plane normal to the plane of the plate or strip, and has a length greater than the thickness of the cover into which it will be embedded.

As a direct result of the configuration and orientation of these prongs, during assembly, the hinge plate or rear ring retaining plate is attached by application of pressure to the cover section, causing the prongs to be embedded in the cover section by moving in a curved or curled pathway in a direction that substantially increases the aforesaid angle, and coming to rest in an angular configuration that firmly attaches the assembly or plate to the cover section. In the completed state, the prongs are fully embedded in the cover, and no part is exposed on the outer surface of the cover. Should the prongs not be configured in the manner described herein, then they will likely come to rest with their tips exposed on the outer surface of the cover, or fail to fully embed in a firm manner.

BRIEF DESCRIPTION OF THE DRAWINGS

Comprehension of certain embodiments of the invention is facilitated by reading the following detailed description in connection with the annexed drawings, in which.

DETAILED DESCRIPTION OF THE PREFERRED EMBODIMENTS

Figure 1:
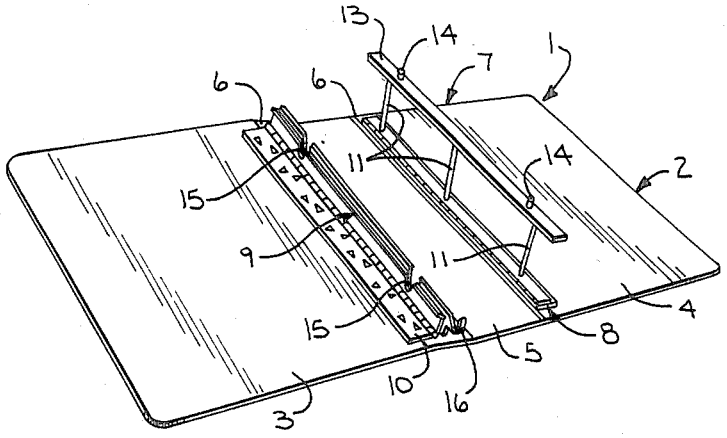
FIG. 1 is a perspective view of a post and lock bar binder of the invention in the open condition.

FIG. 1 illustrates a conventional post and lock bar binder 1 for binding sheet material, such as paper, cards, brochures, and the like. Binder 1 includes a rectilinear cover or backing member 2, comprising a front section 3, a rear section 4, and a spine section 5, therebetween. Spine section 5 interconnects front and rear sections 3 and 4 at junction or hinge lines 6.

Front and rear sections 3 and 4 are preferably formed of paperboard or plastic and can be enclosed on both the inner and outer surfaces with a fabric, paper, or plastic facing, as desired. Spine section 5 can be fabricated from thinner, more flexible material than sections 3 and 4. In accordance with the invention, the cover 2 can be manufactured with automated machinery.

Binder 1 includes a post bar assembly 7, shown in a three-rod ladder configuration, wherein the rear sidepiece is attached, in a manner described below, by hinge assembly 8 to rear section 4. It is to be understood that the number of rods and configuration may take any form that is complementary with the sheet material, such that holes conventionally punched along the perimeter of the sheet material align with the rods of post bar assembly 7. Accordingly, the rear sidepiece of post bar assembly 7 is comprised of posts 11 which slidably receive rods on transfer bar 13, such that posts 11 and rods extend through the punched holes in the sheet material and thereby retain the sheet material in the post bar assembly 7.

Binder 1 further includes lock bar assembly 9, attached, in a manner described below, by hinge assembly 10 to front section 3. Lock bar assembly 9 is designed such that when unlocked, the transfer and post bar assemblies can be accessed and sheet material either added or removed therefrom, and when locked, the sheet material is retained and cannot be removed.

Thus, post bar assembly 7 further comprises lock pins 14 which project outwardly from the outer surface of the front sidepiece of the three-rod ladder configured transfer bar 13. Lock bar assembly 9 comprises slots 15 adapted to receive lock pins 14 when the post bar assembly 7 is swung on hing assembly 8 towards lock bar assembly 9. Lock bar assembly 9 likewise further comprises a slidably parallel mounted locking bar 16, possessing recesses that are complementary with slots 15, such that when locking bar 16 is pushed in a downward direction, relatively parallel to, and along hinge assembly 10, recesses on locking bar 16 align with slots 15, and the lock pins 14 become accessible and post bar assembly 7 removable. Likewise, when locking bar 16 is pushed in an upward direction, recesses on locking bar 16 fall out of alignment with slots 15, and lock pins 14 become inaccessible, and post bar assembly 7 not removable.

It must be understood that the specific embodiment reflecting the locking and removal of post bar assembly 7 are preferred. Accordingly, the instant invention includes many other equivalent binding mechanisms that operate to restrain removal, and provide access to sheet material.

In accordance with the invention, each hinge assembly 8 and 10 includes a metal hinge plate or strip 17 which is mounted to the respective front and rear cover section 3 and 4 by a plurality of critically configured prongs 18 which are punched or stamped out of the plate 17.

Figure 3:
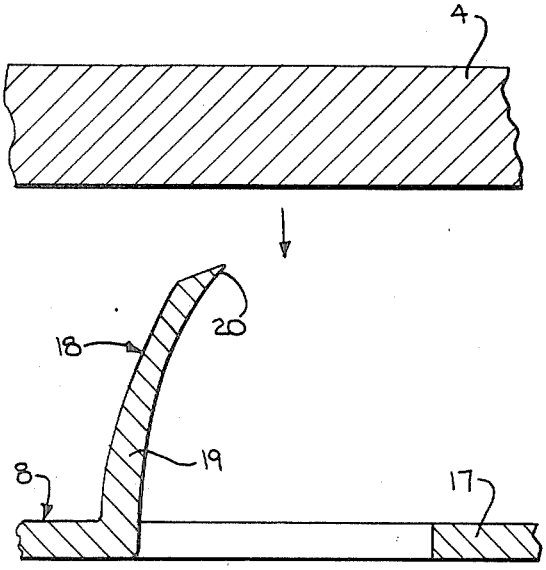
FIG. 3 is an enlarged sectional view of the cover section and metal hinge plate or strip showing a prong punched out in the critical, original angular configuration, to be applied by pressure to the cover section.
Figure 4:
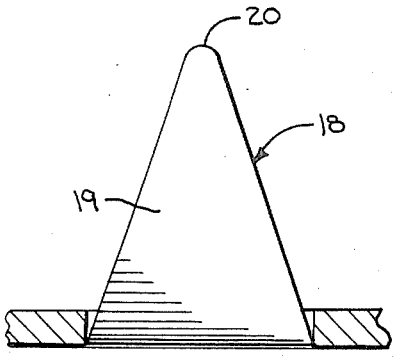
FIG. 4 is an end view of the specific critical structure of the prong shown in FIG. 3.

As illustrated in FIGS. 3 and 4, each prong 18, in its original angular configuration prior to assembly, has a generally curvilinear triangular body 19 terminating in a sharpened tip 20. As shown in FIG. 3, the shaft of prong 18 curves to the tip 20 in a fashion that is critical to the invention, in that it is outward from a plane extending perpendicularly to the strip 17, at an angle in the range of approximately 5 degrees to 15 degrees, and preferrably 10 degrees with respect to the perpendicular plane, or alternatively can be characterized as an angle of 75 degrees to 85 degrees with respect to the plane of strip 17.

Prongs 18 also critically possess a length greater than the thickness of the cover sections 3 and 4, and preferably more than two times the thickness of these cover sections. In practice, the hinge plate 17 can be formed of one quarter inch cold rolled steel, having a thickness of 0.025 inches. With a hinge plate of this thickness, the prongs, when punched or stamped out, will have a length of about 0.025 inches, and the cover sections 3 and 4 will have a thickness greater than 0.100 inches, and generally in the range of 0.100 to 0.152 inches.

Figure 5:
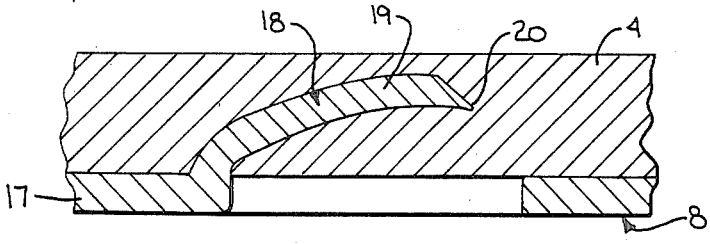
FIG. 5 is a sectional view of the metal hinge plate or strip mounted on the cover section, showing a prong in the fully embedded angular configuration.

Prongs 18 are embedded in cover sections 3 and 4 by the application of pressure either to the strip 17 and against the cover section, or, alternatively, to the cover section and against the strip. As pressure is applied in this manner, pointed tips 20 of prongs 18 penetrate the cover section 3 and 4, and continue to curve in a direction that is inward with respect to the plane of strip 17, or in an increasing angle with respect to the normal to strip 17, as a direct result of the size, shape, configuration and inclination of these prongs in the critical original angular configuration, resulting in the fully embedded angular configuration shown in FIG. 5. Accordingly, when fully embedded, strip 17 will lie flush with cover sections 3 and 4, and the prongs will be located wholly within the thickness of the cover sections with no portion of the prongs exposed on the outer surface of the cover.

Figure 2:
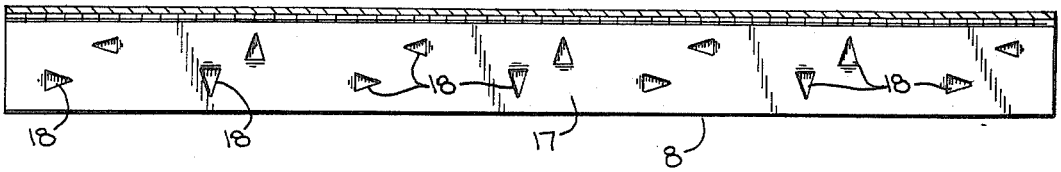
FIG. 2 is a plan view of the metal hinge plate or strip of the post and lock bar binder, before assembly to the cover, and showing the punched out prongs in critical configuration.

Prongs 18 shown in FIG. 2 are placed along strip 17 in the preferred embodiment, as pairs, in which each prong of the pair is parallel to, and curves in a direction opposing, the other prong. By pivoting these pairs in 90 degrees rotational angles, along the length of strip 17, as shown in FIG. 2, greater strength is provided when the strip 17 is attached to cover sections 3 or 4. Alternatively, random rotational angles can be used, and will, as well, result in a firm attachment of strip 17 to cover sections 3 and 4, regardless of the force or stress that may be applied to the binding mechanism during use.

Figure 6:
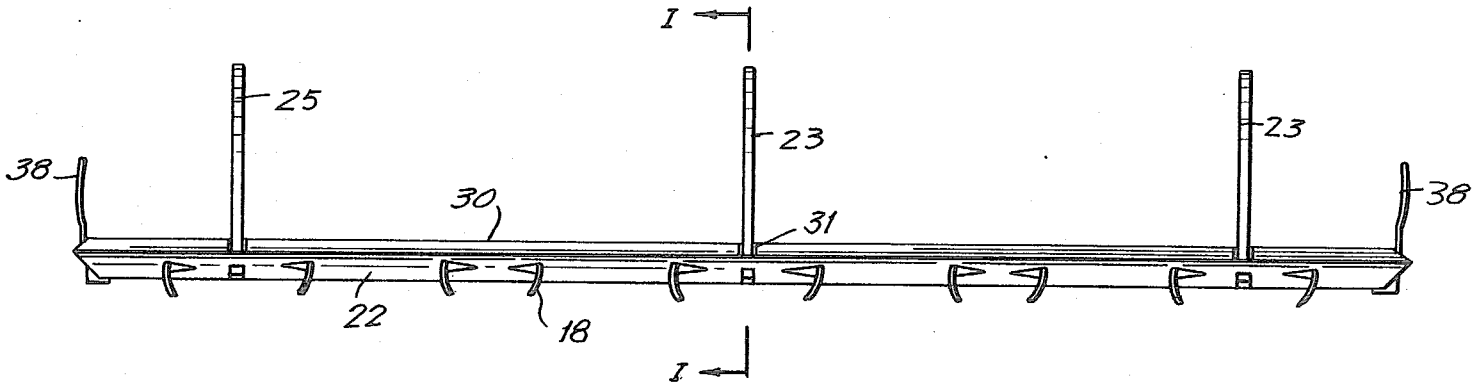
FIG. 6 is a three-ring binder assembly, with a rear binding plate possessing the critically configured, punched out prongs along the length of the assembly.
Figure 7:
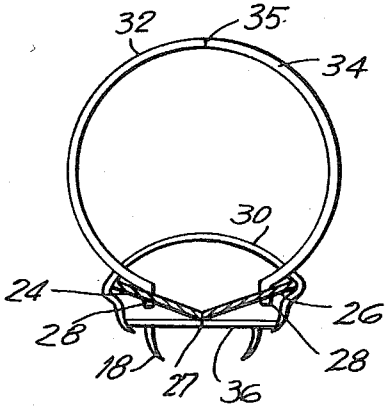
FIG. 7 is a substantially cross-sectional view along line I—I of FIG. 6 with the prongs shown in FIG. 7 oriented 90 degrees from the prongs in FIG. 6.

FIGS. 6 and 7 show a three-ring binder mechanism 22, in conformity with the instant invention. Binder mechanism 22 is attached to cover section 2, as described below, either along the spine section 5 or front or rear section 3 or 4. Binder mechanism 22 includes three rings 23, which are positioned complementary to the holes on the sheet material. Accordingly, any number, size or configuration of these rings that is complementary to the sheet material is also considered to be part of the instant invention.

FIG. 7 is a substantially view along line I—I of FIG. 6, showing ring segments 32 and 34 in the closed position, meeting at their upper ends, at meshing point 35. Ring segments 32 and 34 possess, at their lower ends, ring mountings 28 which attach ring segments 32 and 34 to ring supporting plates 24 and 26, respectively. Plates 24 and 26 meet at pivoting point 27.

In contrast to FIG. 6, prongs 18 in FIG. 7 are oriented 90 degrees from the prongs in FIG. 6. Thus, although the prongs 18 in FIG. 6 would appear in FIG. 7 as in the perspective shown by FIG. 4, if FIG. 7 were an exact cross-section of FIG. 6 along line I—I, the prongs are instead shown in the same perspective as lower FIG. 3. It is to be understood that the specific orientation of prong 18 can be changed without deviating from the scope of the invention, as long as the critical angular configuration of the prongs, as described herein, is maintained.

In the normal operation of the three-ring binder, releases 38 can be used to apply a downward pressure to ring segments 32 and 34, which in turn pivot plates 24 and 26 on pivot point 27, thereby creating a toggle effect. Accordingly, a toggle joint is created by plates 24 and 26 pivoting on point 27, when pressure is applied thereto, either by releases 38, or by direct action on the ring segments 32 and 34 themselves. Once pressure is exerted to a point at which the toggle occurs, plates 24 and 26 pivot downwardly, as toggle point 27 moves upwardly, and a gap is formed between ring segments 32 and 34, due to the attachments 28 to plates 24 and 26. Reversing this action results in the closure of ring segments 32 and 34, as is shown in FIG. 7.

Deformed around the ends of plates 24 and 26 opposite to point 27 is a confining cover member 30 which further extends to retain the entire assembly. Cover member 30 has recesses 31 to provide for the movement of ring segments 32 and 34. Below point 27 is a rear binding plate 36 which extends along substantially the entire length of binder mechanism 22, and is attached to mechanism 22 by confining cover member 30.

Binding plate 36 possesses prongs 18, which are formed in substantial conformity with the critical embodiment represented in FIG. 2, and are shown in FIG. 7 in the original angular configuration, prior to attachment to cover section 2. Accordingly, during assembly, when pressure is applied to either binder mechanism 22 or cover section 2, prongs 18, due to their critical original configuration, follow the path shown in FIG. 5, and result in a fully embedded angular configuration, possessing rigidity and strength sufficient for the toggle effect, wholly within the thickness of the cover section 2, and without any exposed portions. Moreover, manufacturing and assembly of this binder can occur through use of automated equipment.

The instant invention can accordingly be used with any binder for sheet material. It must be further understood that the specific structures herein are disclosed in the figures as specific embodiments, and can carry any other form that meets and satisfies the principles of the invention herein. Accordingly, although the invention has been described in terms of the specific embodiments and applications, persons skilled in the art, in light of these teachings, can generate additional embodiments without exceeding the scope or departing from the spirit of the claimed invention. It is to be further understood that the drawings and the descriptions in this disclosure are preferred to facilitate the comprehension of the invention and should not be construed to limit the scope thereof.

I claim:

1. A method of fabricating a binder for sheet material comprising the steps of forming a non-metallic cover including a front cover section, a rear cover section and a spine connecting said cover sections;

joining each cover section to said spine along a hinge line;

stamping out a plurality of prongs at angles of between 75 degrees and 85 degrees from at least one metal plate of a binding mechanism, each prong having a length at least two times greater than the thickness of the corresponding cover section;

disposing said at least one metal plate flatwise against the respective cover section;

embedding said prongs in the respective cover section and thereby bending them so that they come to rest at substantially smaller angles, said prongs being confined wholly within the thickness of the respective cover section and no portion of said prongs being exposed on the opposite surface of the respective cover section.

2. The method of claim 1 including the step of randomly orienting said prongs with respect to said plate.

3. The method of claim 1, wherein said metal plate comprises a portion of a hinge assembly.

4. The method of claim 1, wherein said metal plate is a binding plate, attached to the rear face of a toggled binder mechanism.

5. In a binder construction;

a non-metallic cover having a thickness in the range of 0.100 to 0.152 inch;

at least one metal plate of a binding mechanism disposed flatwise against said cover;

a plurality of prongs generally triangular in shape and having a curved sharpened tip, stamped out at angles of between 75 degrees and 85 degrees from said plate and having a length at least twice as great as the thickness of said cover;

said prongs when embedded in said cover bending and coming to rest at substantially smaller angles with no portion of said prongs being exposed on the opposite surface of said cover.

6. The binder construction of claim 5 wherein said cover is formed of paperboard.

7. The binder construction of claim 5, wherein the tips of a first group of said prongs are facing in one direction and the tips of a second group of said prongs are facing in the opposite direction.

8. The binder construction of claim 5, wherein said prongs are randomly oriented, so that the tips of said prongs face in random directions.

9. The binder construction of claim 5, wherein said metal plate comprises a portion of a hinge.

10. The binder construction of claim 5, wherein said metal plate is a binding plate, attached to the rear face of a toggled binder mechanism.

11. In a ring binder having a cover and a toggle mechanism;

said cover being non-metallic and having a thickness in the range of 0.100 to 0.152 inch;

said toggle mechanism attached to a first side of a metal plate substantially along the entire length thereof;

a plurality of prongs generally triangular in shape and having a curved sharpened tip, stamped out from said metal plate at angles of between 75 degrees and 85 degrees from a second side of said metal plate and having a length at least twice as great as the thickness of said cover;

said second side of said metal plate disposed flatwise against said cover;

said prongs when embedded in said cover bending and coming to rest at substantially smaller angles with no portion of said prongs being exposed on the opposite surface of said cover.

12. In a binder construction, a non-metallic cover including a front cover section, a rear cover section and a spine connecting said cover sections, each cover section being joined to said spine along a hinge line, a hinge assembly attached to each cover section adjacent to said hinge line and each hinge assembly including a metal hinge plate disposed flatwise against the respective cover section, a plurality of prongs stamped out at angles of between 75 degrees and 85 degrees from said hinge plate and when embedded in the respective cover section bending and coming to rest at substantially smaller angles, each prong being generally triangular in shape and being curved throughout its length and terminating in a sharpened tip, each prong having a length at least two times greater than the thickness of the corresponding cover section, said prongs being confined wholly within the thickness of the respective cover section and no portion of said prong being exposed on the opposite surface of the cover section.

13. In a post and lock bar binder having a cover, a post assembly attached to a hinge assembly, and a lock bar assembly attached to a hinge assembly, the improvement comprising a plurality of prongs, affixed to each of said hinge assemblies, protruding at angles of between 75 degrees and 85 degrees from said hinge assemblies, and when embedded into said cover said prongs bending into substantially smaller angles, each prong generally triangular in shape, curved throughout its length, and terminating in a sharpened tip.

14. The improvement of claim 13, wherein the length of each prong is substantially greater than the thickness of the cover.

15. The improvement of claim 14, wherein the cover is comprised of a nonmetallic material.

16. The improvement of claim 15, wherein said prongs are confined wholly within the thickness of the cover, with no portion of said prongs exposed on the surface of the cover opposite to the point of attachment to each hinge assembly.

* * * * *